US009631300B2

(12) United States Patent
Stündl

(10) Patent No.: US 9,631,300 B2
(45) Date of Patent: Apr. 25, 2017

(54) DEVICE FOR PNEUMATICALLY CONVEYING AND GUIDING A MULTIFILAMENT THREAD

(71) Applicant: Oerlikon Textile GmbH & Co. KG, Remscheid (DE)

(72) Inventor: Mathias Stündl, Wedel (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 0 days.

(21) Appl. No.: 14/770,672

(22) PCT Filed: Feb. 17, 2014

(86) PCT No.: PCT/EP2014/053014

§ 371 (c)(1),
(2) Date: Aug. 26, 2015

(87) PCT Pub. No.: WO2014/131641

PCT Pub. Date: Sep. 4, 2014

(65) Prior Publication Data

US 2016/0002830 A1 Jan. 7, 2016

(30) Foreign Application Priority Data

Feb. 28, 2013 (DE) ..... 10 2013 003 408

(51) Int. Cl.
*D02G 1/16* (2006.01)
*D02J 1/08* (2006.01)
(Continued)

(52) U.S. Cl.
CPC ..... *D02G 1/122* (2013.01); *B65H 51/16* (2013.01); *D02G 1/161* (2013.01); *D02J 1/08* (2013.01); *B65H 2701/313* (2013.01)

(58) Field of Classification Search
CPC ..... D02G 1/122; D02G 1/16; D02G 1/161; D02G 1/162; D02G 1/024; D02G 1/167;
(Continued)

(56) References Cited

U.S. PATENT DOCUMENTS 2,052,869 A * 9/1936 Coanda ..... D02G 1/161 131/211
2,584,043 A * 1/1952 Oberly ..... D01D 10/0481 134/105
(Continued)

FOREIGN PATENT DOCUMENTS

DE 2236957 A1 2/1973
DE 2303491 A1 8/1974
(Continued)

*Primary Examiner* — Amy Vanatta
(74) *Attorney, Agent, or Firm* — BainwoodHuang

(57) ABSTRACT

A device for pneumatically conveying and guiding a multifilament thread has a closed conveying channel which has a thread inlet opening at one end and a thread outlet opening at the opposite end. An injector zone having at least one compressed air channel which opens into the conveying channel is formed between the thread inlet opening and the thread outlet opening, wherein the compressed air channel can be connected to a compressed air source. In order to avoid blowing air from flowing back from the injector zone at the thread inlet opening, a return flow channel is formed in a channel section of the conveying channel between the thread inlet opening and the opening of the compressed air channel, which return flow channel connects the conveying channel to ambient atmosphere.

9 Claims, 2 Drawing Sheets

Figure 1:
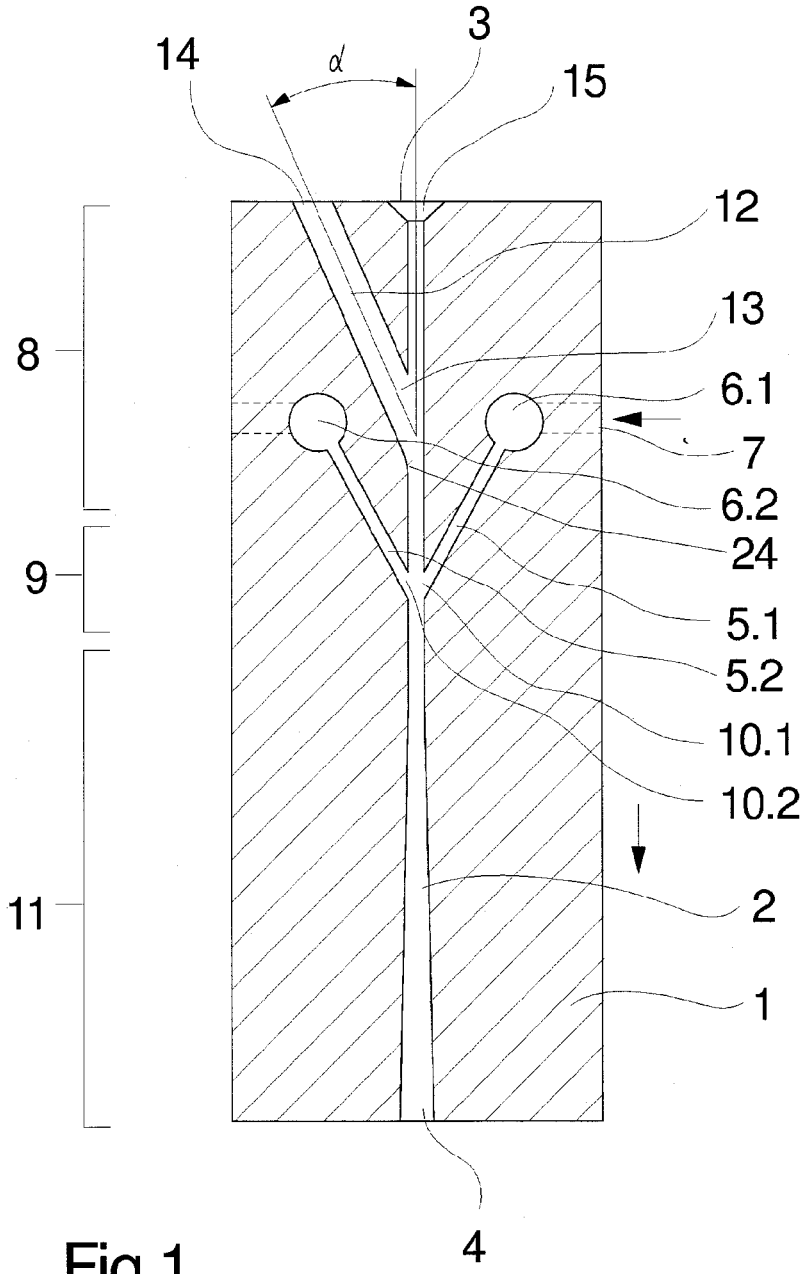

(51) Int. Cl.
*D02G 1/12* (2006.01)
*B65H 51/16* (2006.01)

(58) Field of Classification Search
CPC . D02G 1/006; D02G 1/164; D02J 1/08; D02J 1/06; B65H 51/16; D01H 4/02; D01H 1/115
USPC ..... 28/271, 254, 268, 272, 273, 274
See application file for complete search history.

(56) References Cited

U.S. PATENT DOCUMENTS 3,703,751 A 11/1972 Bowen
3,718,270 A * 2/1973 Parmeggiani ..... B65H 51/16 226/97.4
3,822,543 A * 7/1974 Edagawa ..... D02G 1/165 28/254
3,978,558 A * 9/1976 Pike ..... D02G 1/161 28/274
4,041,586 A * 8/1977 Foster ..... D02G 1/122 28/254
4,069,564 A * 1/1978 Trifunovic ..... D02G 1/161 28/273
4,125,922 A * 11/1978 Irwin ..... D02J 1/08 28/221
4,974,302 A * 12/1990 Nabulon ..... D02G 1/122 28/256
5,579,566 A * 12/1996 Burkhardt ..... D02G 1/122 28/254
6,134,759 A * 10/2000 Saijo ..... D02J 1/08 28/271
2003/0177751 A1* 9/2003 Stalder ..... D01H 1/115 57/403
2004/0031134 A1* 2/2004 Koslowski ..... D02G 1/122 28/263
2006/0005365 A1* 1/2006 Stundl ..... D02G 1/122 28/263
2011/0277285 A1* 11/2011 Simmen ..... D02J 1/08 28/271

FOREIGN PATENT DOCUMENTS

DE 2734220 A1 2/1979
DE 19826654 A1 12/1998
EP 0539808 A1 5/1993
EP 1614782 A1 1/2006
WO 0164982 A2 9/2001
WO 2010086258 A1 8/2010

* cited by examiner

DEVICE FOR PNEUMATICALLY CONVEYING AND GUIDING A MULTIFILAMENT THREAD

The invention relates to a device for pneumatically conveying and guiding a multifilament thread as disclosed herein.

In melt-spinning processes or textile processes it is known for a running thread to be pneumatically guided and conveyed by means of a nozzle-type device. To this end, a compressed-air stream, which catches a thread entering through a thread inlet opening into a conveying duct and conveys said thread to a thread outlet opening, is inducted within the conveying duct. Depending on the positive pressure of the compressed air which is supplied to the conveying duct, a high conveying force is generated on the thread on account of the expanding compressed air. In the case of comparatively high positive pressures of the compressed air, a return stream is established within the conveying duct, which return stream exits from the thread inlet opening counter to the running direction of the thread. However, such return streams of the compressed air hamper the entry of the thread. It is known in particular that, on account of the returning air stream, individual broken filaments of the multifilament thread are hampered when entering the conveying duct.

This phenomenon is known in the prior art, with various attempts having been made at avoiding return streams of this type in the conveying duct. DE 22 36 957 A1 discloses a device for pneumatic conveying and guiding, in which the conveying duct in the region below the compressed-air supply has a cascade-type widening of the cross section. Therewith, return streams of the air to the thread inlet opening may indeed be reduced, but with the great disadvantage of reduced conveying capability.

DE 27 34 220 A1 discloses a further device for pneumatically guiding and conveying a multifilament thread, in which the conveying duct in an entry region has an aperture labyrinth which forms a plurality of expansion spaces. Therewith, throttling of the returning air stream is achieved, such that only reduced return streams arise at the thread inlet opening. However, additional apertures and throttles of this type in the conveying duct hamper thread entry by way of an accumulation of entrained ambient air on the thread, which facilitates a broken filament in breaking out into one of the expansion spaces.

It is now the object of the invention to refine a device of the generic type for pneumatically conveying and guiding a multifilament thread in such a manner that trouble-free entry of the thread and a high conveying effect are simultaneously possible in the case of high positive pressures of the compressed air.

This object is achieved according to the invention in that a return stream duct opens into a duct portion of the conveying duct, between the thread inlet opening and the mouth of the compressed-air duct, said return stream duct connecting the conveying duct to an ambient atmosphere.

Advantageous refinements of the invention are defined by the features and combinations of features disclosed herein.

The invention is based on the insight that rapid air streams preferably cling to walls and flow therealong. Such physical properties are also known as so-called Coandă effects. To this extent, the natural behavior of the stream within the conveying duct is used to obtain dissipation of the return stream into a return stream duct. Therewith, the return stream of the blower air can be diverted into an ambiance which is not critical to thread guiding.

In order for as large a proportion of the return stream from the conveying duct as possible to be able to be received, according to one advantageous refinement of the invention the return stream duct opens out having an inclination in the conveying direction of the conveying duct. The inclination of the return stream duct is substantially defined by an angle in the range of 5° to 40° between the return stream duct and the duct portion of the conveying duct between the thread inlet opening and the mouth of the compressed-air duct. Therewith, the deflection of the return stream from out of the conveying duct can be facilitated.

In order that the so-called Coandă effect catches a major part of the return stream in a particularly pronounced manner, the refinement of the invention in which the return stream duct and the conveying duct in the mouth region on the side facing the compressed-air duct form a transition face which is rounded is preferably implemented. Therewith, even slight negative pressures in the mouth region of the return stream duct, which lead to ambient air being suctioned from the thread inlet opening, can be generated. Guiding of the multifilament thread is particularly facilitated therewith.

The effectiveness of stream deflection can even be improved in that according to one advantageous refinement of the invention a supply stream duct opens into the duct portion of the conveying duct in the region of the mouth of the return stream duct, and in which the inflow duct connects the conveying duct to an ambient atmosphere. The additional air supply to the mouth region of the return stream duct facilitates stream deflection of the returning blower-air stream.

In order for radiation deflection caused by the Coandă effect on the wall of the conveying duct in the mouth region of the return stream duct to be amplified, the mouth of the stream duct lies opposite the mouth of the return stream duct, wherein the opening cross section of the mouth of the inflow duct is configured so as to be smaller than the opening cross section of the mouth of the return stream duct.

Moreover, the additional supply air is inducted in a substantially transverse manner into the conveying duct, such that the supply stream duct in the mouth region encloses an angle in the range of 80° to 100° with the conveying duct.

The device according to the invention is particularly suitable for immediately carrying out further treatment of the thread in a melt-spinning process, since both broken filaments as well as loops protruding from the composite thread may pass without hindrance into the thread inlet opening of the conveying duct. To this extent, the refinement of the invention in which the conveying duct by way of the thread outlet opening opens into a stuffer box, by way of which the thread is compressible to a thread plug, is preferably implemented. This variant of the device is used for crimping threads and is preferably used in the manufacture of carpet yarns.

Figure 2:
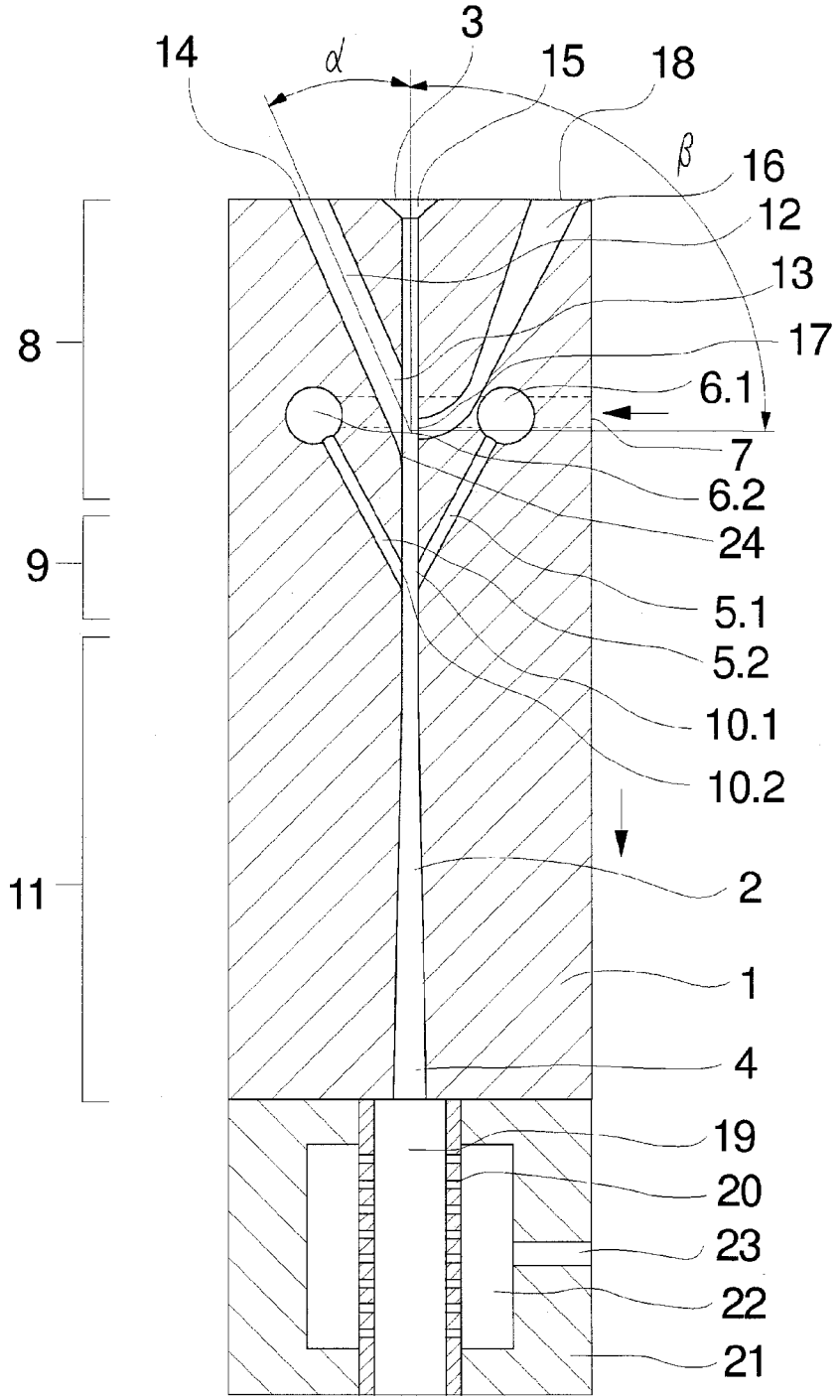

The device according to the invention will be explained in more detail in the following by means of a few exemplary embodiments with reference to the appended figures, in which:

FIG. 1 schematically shows a cross-sectional view of a first exemplary embodiment of the device according to the invention;

FIG. 2 schematically shows a cross-sectional view of a further exemplary embodiment of the device according to the invention.

A first exemplary embodiment of the device according to the invention is schematically illustrated in a cross-sectional view in FIG. 1. An elongate closed conveying duct 2, which at an upper end is connected to a thread inlet opening 3 and at the lower end is connected to the ambiance by way of a thread outlet opening 4, is configured in a nozzle body 1. The thread inlet opening 3 has an inlet funnel 15 in order for entry of a thread into the conveying duct 2 to be facilitated. The conveying duct 2 may be configured as a bore or as a groove, wherein the nozzle body could be constructed so as to be integral or in multiple parts.

Two mirror-symmetrically configured compressed-air ducts 5.1 and 5.2, which open into the conveying duct 2 at an inclination, are provided in an upper third of the conveying duct 2, between the thread inlet opening 3 and the thread outlet opening 4. The mouths 10.1 and 10.2 of the compressed-air ducts 5.1 and 5.2 are opposite one another on the wall of the conveying duct 2. By way of the opposite ends, the compressed-air ducts 5.1 and 5.2 are connected to at least one compressed-air connector opening 7 via supply ducts 6.1 and 6.2. A compressed-air source (not illustrated here) can be connected to the nozzle body 1 by way of the compressed-air connector opening 7.

The mouths of the compressed-air ducts 10.1 and 10.2 on the conveying duct 2 form the so-called injector zone 9 in which compressed air meets for the first time a thread which is guided within the conveying duct 2. The region above the injector zone here is defined as the thread entry zone 8, and the region below the injector zone 9 is defined as the expansion zone 11.

In order to be able to pneumatically guide and convey a thread within the conveying duct 2, compressed air is supplied via the compressed-air ducts 5.1 and 5.2. A blower-air stream in the direction of the thread outlet opening 4 is created in the portion of the conveying duct 2 of the injector zone 9. In order to support the blower-air stream, the duct portion of the conveying duct 2 in the region of the expansion zone 11 advantageously has a widening of the duct, such that additional acceleration of the blower air arises.

On account of the pulse-type inflow of compressed air in the injector zone, comparatively high back pressures are created which cause a return stream of the blower air in the direction of the thread inlet opening 3. In order for the returning blower-air stream to be kept away from the region of the thread inlet opening 3, a return stream duct 12 is provided in the nozzle body 1.

The return stream duct 12, which opens into the conveying duct 2 at an inclination in the conveying direction, is configured in the thread entry zone 8, in the duct portion of the conveying duct 2 between the thread inlet opening 3 and the mouth of the compressed-air duct 10.1 and 10.2. The conveying direction of the conveying duct 2 is identified by a vertical arrow in FIG. 1.

The inclination of the return stream duct 12 in FIG. 1 is identified by the angle $\alpha$. The angle $\alpha$ is in a range of 5° to 40°, so as to be able to receive a returning blower-air stream resulting from the injector zone 9 at the mouth 13 of the return stream duct 12.

In order for the dissipation of the returning blower-air stream into the return stream duct 12 to be facilitated, a rounded transition face 24, which is effective in relation to the conveying duct 2, is molded on the mouth 13 of the return stream duct 12. Wall contours of this type are particularly suitable for automatically guiding the return stream of blower air, which is guided on the wall of the conveying duct 2, into the return stream duct 13 by way of the so-called Coandă effect. In the case of high stream velocities of the blower air, negative pressure is formed here between the wall and the stream, such that the return stream from out of the conveying duct 2 is diverted into the return stream duct 12. Additionally, on account of negative pressure in the mouth region of the return stream duct 12, suction which acts on the thread inlet opening 3 is generated. This suction effect facilitates thread entry into the conveying duct even in the case of multifilament threads having broken filaments or projecting filament loops.

In order for dissipation of the returning blower-air stream to be facilitated, the return stream duct 12 has a duct cross section which is larger than a duct cross section of the conveying duct 2 in the mouth region of the return stream duct 12. Therewith, additional widening of the cross section can be implemented in order to accelerate the return stream of blower air.

The exemplary embodiment of the device according to the invention as per FIG. 1 is suitable for pneumatically guiding and conveying individual multifilament threads or a group of a plurality of multifilament threads or a group of filaments within a melt-spinning process. There is thus the possibility that the nozzle body is formed by two nozzle halves which lie opposite one another in order to form a groove-like conveying duct. Therewith, groups of threads and filaments can also be advantageously guided.

A further exemplary embodiment of the device according to the invention for pneumatically conveying and guiding a multifilament thread is illustrated in FIG. 2. In the device shown in FIG. 2, the nozzle body 1 could also be formed from two nozzle halves, wherein the view of the illustration in FIG. 2 would correspond to a plan view of one of the nozzle halves. Independently of the type and construction of the nozzle body 1, a conveying duct 2 which extends between a thread inlet opening 3 and a thread outlet opening 4 is configured within the nozzle body 1. An injector zone 9 having the compressed-air ducts 5.1 and 5.2 is configured in the first third of the conveying duct 2. The compressed-air ducts 5.1 and 5.2 are connected to a compressed-air connector opening 7 by way of the supply ducts 6.1 and 6.2.

A return stream duct 12 is configured in the nozzle body 1, in the region of the thread entry zone 8 of the conveying duct 2. The return stream duct 12 extends between a return stream opening 14, which is connected to the ambiance, and the one mouth 13 in the conveying duct 2. The mouth region of the mouth 13 and the inclination angle $\alpha$ of the return stream duct 21 is implemented so as to be substantially identical to the aforementioned exemplary embodiment, so that no further explanations are included to this end.

An inflow duct 16 opens out on the wall of the conveying duct 2, which is opposite the mouth 13 of the return stream duct 12. The inflow duct 16 here extends between a mouth 17 on the conveying duct 2 and an inflow opening 18 which connects the inflow duct 16 to the ambiance. The inflow duct 16, opposite the mouth 13 of the return stream duct 12, opens out into the conveying duct 2 in a substantially orthogonal manner. The inclination angle of the inflow duct 16 in FIG. 2 is identified by the angle $\beta$. The angle $\beta$ is in a range of 80° to 100°.

A connector body 21, which in the extension of the conveying duct 2 forms a stuffer box 19, is disposed below the nozzle body 1. In an exemplary manner, the connector body 21 is illustrated as an additional component to the nozzle body 1. In principle, there is also the possibility for the connector body 21 to be integrated in the nozzle body 1.

Independently of the constructive implementation, the thread outlet opening 4 of the conveying duct 2 opens out in a substantially concentric manner in relation to the stuffer box 19. The stuffer box 19 is formed by an air-permeable stuffer box wall 20 which is surrounded by a relief chamber 22. The relief chamber 22 is connected to the ambiance by way of a relief opening 23.

The exemplary embodiment of the device according to the invention which is illustrated in FIG. 2 is used for texturizing multifilament synthetic threads in stuffer boxes. To this end, compressed air is supplied during operation via the compressed-air connector opening 7 to the compressed-air ducts 5.1 and 5.2, such that blower air in the conveying direction is generated within the conveying duct 2. A thread which is guided in the conveying duct 2 is pneumatically conveyed by the blower air and is guided into the stuffer box 19 with high energy. Within the stuffer box 19, the multifilament thread is stuffed to form a thread plug, wherein the filaments are deposited in bows and loops on the surface of the plug. The thread plug is compressed on account of the blower air, wherein ventilation occurs via the air-permeable stuffer box wall 20.

The returning blower-air stream from the injector zone 9 in the direction of the thread inlet opening 3 is deflected via the mouth region of the mouth 13 of the return stream duct 12 and exhausted via the return stream duct 12 into the ambiance. Ambient air is suctioned, on the one hand, from the thread inlet opening 3 and from the inflow duct 16, on account of negative pressure which is generated thereby in the conveying duct 2. Deflection of the returning blower-air stream is particularly supported by the ambient air which flows transversely via the inflow duct 16 into the conveying duct 2, such that substantially the entire returning blower-air stream can be dissipated via the return stream duct 13 into the ambiance.

It is essential here for the mouth 17 of the inflow duct 16 to have an opening cross section which is smaller than the mouth 13 of the return stream duct 12, which preferably is configured so as to be opposite thereto. It is therewith achieved that the blower-air return stream advantageously bears on the opposite wall and thus an intensified Coandă effect for deflecting the stream arises.

The exemplary embodiment which is illustrated in FIG. 2 is particularly suitable for compressed-air operated texturizing nozzles for manufacturing BCF yarns. In melt-spinning processes of this type, processing speeds of beyond 2500 m/min are reached, requiring a corresponding conveying and traction effect. To this end, positive pressures of the blower air in the range of 4 to 5 bar are achieved in the injector zone 9 of the conveying duct 2, in order to maintain a corresponding conveying power. The comparatively high positive pressure within the injector zone 9 demands corresponding strong return streams of blower air into the thread entry region 8, which are advantageously deflected from the conveying duct 2 by way of the interaction of the return stream duct 12 and the inflow duct 16.

The duct cross sections of the conveying duct 2, of the return stream duct 12, and of the inflow duct 16, which are illustrated in the exemplary embodiment as per FIGS. 1 and 2, are exemplary. It is essential here that deflection of the return stream of the blower air between the thread inlet opening 3 of the conveying duct 2 and the injector zone 9 is possible on account of the Coandă effect.

LIST OF REFERENCE SIGNS

1 Nozzle body
2 Conveying duct
3 Thread inlet opening
4 Thread outlet opening
5.1, 5.2 Compressed-air duct
6.1, 6.2 Supply duct
7 Compressed-air connector opening
8 Thread entry zone
9 Injector zone
10.1, 10.2 Mouth of the compressed-air duct
11 Expansion zone
12 Return stream duct
13 Mouth of the return stream duct
14 Return stream opening
15 Inlet funnel
16 Inflow duct
17 Mouth of the inflow duct
18 Inflow opening
19 Stuffer box
20 Stuffer box wall
21 Connector body
22 Relief chamber
23 Relief opening
24 Transition face

The invention claimed is:

1. A device for pneumatically conveying and guiding a multifilament synthetic thread, the device comprising:

a closed conveying duct which at a first end has a thread inlet opening and at a second end, being opposite the first end, has a thread outlet opening;

at least one compressed-air duct which opens into the conveying duct in an injector zone of the conveying duct, which injector zone is formed between the thread inlet opening and the thread outlet opening wherein the compressed-air duct is connectable to a compressed-air source; and a return stream duct opening into a duct portion of the conveying duct, between the thread inlet opening and a mouth of the compressed-air duct, the return stream duct connecting the conveying duct to an ambient atmosphere;

wherein the return stream duct opens out having an inclination in a conveying direction of the conveying duct; and wherein a mouth of the return stream duct is configured such that a rounded transition face is formed between the return stream duct and the conveying duct, said transition face being rounded in a stream direction.

2. The device as claimed in claim 1, wherein the inclination of the return stream duct is defined by an angle in the range of 5° to 40° between the return stream duct and the duct portion of the conveying duct between the thread inlet opening and the mouth of the compressed-air duct.

3. The device as claimed in claim 1, wherein the return stream duct has a duct cross section which is larger than a duct cross section of the conveying duct in the region of the mouth of the return stream duct.

4. The device as claimed in claim 1, wherein an inflow duct opens into the duct portion of the conveying duct in the region of the mouth of the return stream duct, and wherein the inflow duct connects the conveying duct to an ambient atmosphere.

5. The device as claimed in claim 4, wherein a mouth of the inflow duct has an opening cross section which is smaller than the mouth of the return stream duct.

6. The device as claimed in claim 4, wherein the inflow duct in the region of a mouth of the inflow duct encloses an angle in the range of 80° to 100° with the conveying duct.

7. The device as claimed in claim 1, wherein the conveying duct by way of the thread outlet opens into a stuffer box, by way of which the thread is compressible to a thread plug.

8. The device as claimed in claim 5, wherein the mouth of the return stream duct is configured so as to be opposite the mouth of the inflow duct.

9. A device for pneumatically conveying and guiding a multifilament synthetic thread, the device comprising:

a closed conveying duct which at a first end has a thread inlet opening and at a second end, being opposite the first end, has a thread outlet opening, at least one compressed-air duct which opens into the conveying duct in an injector zone of the conveying duct, which injector zone is formed between the thread inlet opening and the thread outlet opening, wherein the compressed-air duct is connectable to a compressed-air source, and a return stream duct opening into a duct portion of the conveying duct, between the thread inlet opening and a mouth of the compressed-air duct, the return stream duct connecting the conveying duct to an ambient atmosphere, wherein an inflow duct opens into the duct portion of the conveying duct only in the region of a mouth of the return stream duct, and wherein the inflow duct connects the conveying duct to an ambient atmosphere.

* * * * *